US010024048B2

(12) United States Patent
Getz

(10) Patent No.: US 10,024,048 B2
(45) Date of Patent: Jul. 17, 2018

(54) SYSTEMS AND METHODS FOR FRAMING COMPONENTS INCLUDING BRACKETS WITH FLEX-FIT FLANGES

(71) Applicant: Farm Boy Builder, LLC, Phoenix, AZ (US)

(72) Inventor: Jeffrey Getz, Phoenix, AZ (US)

( * ) Notice: Subject to any disclaimer, the term of this patent is extended or adjusted under 35 U.S.C. 154(b) by 0 days.

(21) Appl. No.: 15/725,134

(22) Filed: Oct. 4, 2017

(65) Prior Publication Data

US 2018/0094423 A1 Apr. 5, 2018

Related U.S. Application Data

(60) Provisional application No. 62/403,936, filed on Oct. 4, 2016, provisional application No. 62/454,378, filed on Feb. 3, 2017.

(51) Int. Cl.
*E04C 3/02* (2006.01)
*E04B 1/24* (2006.01)
(Continued)

(52) U.S. Cl.
CPC ..... *E04B 1/2403* (2013.01); *E04C 3/06* (2013.01); *E04B 2001/2415* (2013.01); *E04C 2003/0473* (2013.01)

(58) Field of Classification Search
CPC ..... E04B 1/2403; E04B 2001/2415; E04B 1/2608; E04B 2/763; E04B 2/761; E04B 2/767; E04B 2001/2448; E04B 5/14; E04B 2001/2457; E04B 2001/2472; E04B 2002/7485; Y10T 403/4602; Y10T 403/4605; E04C 3/07
(Continued)

(56) References Cited

U.S. PATENT DOCUMENTS 3,103,263 A 9/1963 Leeser
4,464,074 A 8/1984 Green et al.
(Continued)

FOREIGN PATENT DOCUMENTS

GB 192837 2/1923
GB 2463319 3/2010
(Continued)

OTHER PUBLICATIONS

Connectors for Cold-Formed Steel Construction, C-CFS-15, 2015, 172 pages.
(Continued)

*Primary Examiner* — Chi Q Nguyen
(74) *Attorney, Agent, or Firm* — Polsinelli PC; Ari M. Bai

(57) ABSTRACT

A bracket is disclosed. The bracket is coupled to a joist by rotating the bracket relative to the joist until the longitudinal axis of the bracket is aligned in parallel orientation with the longitudinal axis of the joist to achieve a snap-in engagement. The bracket includes a first bracket section having a first lateral wing and an opposite second lateral wing extending outwardly from a base of the first bracket section and a second bracket section that is aligned in perpendicular orientation relative to the first bracket section. The first lateral wing is configured to flex relative to the base, and the second lateral wing is configured to flex relative to the base during engagement of the bracket to a joist.

14 Claims, 16 Drawing Sheets

(51) Int. Cl.
*E04C 3/06* (2006.01)
*E04C 3/04* (2006.01)

(58) Field of Classification Search
USPC ..... 52/712, 655.1, 653.1, 668, 745.05, 696, 52/715, 243; 403/231, 232.1; 248/247, 248/217.3, 220.1, 220.21
See application file for complete search history.

(56) References Cited

U.S. PATENT DOCUMENTS

| | | | | |
|---|---|---|---|---|
| 4,846,437 | A | 7/1989 | Fitzgerald | |
| 5,076,536 | A | 12/1991 | Fitzgerald | |
| 5,205,942 | A | 4/1993 | Fitzgerald | |
| 5,325,651 | A | 7/1994 | Meyer et al. | |
| 5,640,823 | A | 6/1997 | Bergeron et al. | |
| 5,720,571 | A * | 2/1998 | Frobosilo | E04B 2/96 403/2 |
| 5,846,018 | A * | 12/1998 | Frobosilo | E04B 2/96 403/2 |
| 5,906,080 | A | 5/1999 | diGirolamo et al. | |
| 6,213,679 | B1 * | 4/2001 | Frobosilo | E04B 2/82 403/14 |
| 6,230,467 | B1 | 5/2001 | Leek | |
| 6,247,677 | B1 | 6/2001 | Vinet et al. | |
| 6,418,694 | B1 | 7/2002 | Daudet et al. | |
| 6,430,890 | B1 | 8/2002 | Chiwhane et al. | |
| 6,609,344 | B2 * | 8/2003 | Saldana | E04B 1/2403 52/243 |
| 6,691,478 | B2 | 2/2004 | Daudet et al. | |
| 7,104,024 | B1 | 9/2006 | diGirolamo et al. | |
| 7,114,695 | B2 | 10/2006 | DeLoach, Sr. | |
| 7,216,465 | B2 | 5/2007 | Saldana | |
| 7,478,508 | B2 * | 1/2009 | Peterson | E04B 2/96 248/300 |
| 7,503,150 | B1 | 3/2009 | diGirolamo et al. | |
| D667,289 | S | 9/2012 | Preda | |
| 8,555,592 | B2 | 10/2013 | Daudet et al. | |
| 8,559,592 | B2 * | 10/2013 | Betcke | A61B 6/032 378/19 |
| 8,950,151 | B2 * | 2/2015 | Strickland | E04B 1/24 52/655.1 |
| D731,876 | S | 6/2015 | Di Stefano | |
| 2003/0093969 | A1 | 5/2003 | Saldana | |
| 2004/0020137 | A1 | 2/2004 | Battey et al. | |
| 2005/0072099 | A1 * | 4/2005 | Roesset | E04B 1/2608 52/633 |
| 2005/0229529 | A1 | 10/2005 | Frascari | |
| 2006/0096201 | A1 * | 5/2006 | Daudet | E04B 1/24 52/272 |
| 2006/0196143 | A1 | 9/2006 | Roesset et al. | |
| 2011/0219720 | A1 | 9/2011 | Strickland et al. | |
| 2012/0247059 | A1 | 10/2012 | Daudet et al. | |
| 2013/0000242 | A1 | 1/2013 | Ferguson et al. | |
| 2013/0125400 | A1 | 5/2013 | Clapp et al. | |
| 2014/0290175 | A1 | 10/2014 | Kleim | |
| 2015/0184371 | A1 | 7/2015 | Stauffer et al. | |
| 2015/0275513 | A1 | 10/2015 | Feldpausch et al. | |

FOREIGN PATENT DOCUMENTS

| | | |
|---|---|---|
| GB | 2467039 | 7/2010 |
| JP | D1078434 | 7/2000 |
| JP | D1045701 | 12/2000 |
| JP | D1260864 | 1/2006 |
| JP | D1286467 | 11/2006 |
| JP | 2007032097 | 2/2007 |
| JP | D1299795 | 5/2007 |
| JP | D1491539 | 3/2014 |
| JP | D1530744 | 8/2015 |
| KR | 300779466 | 1/2015 |
| KR | 300790519 | 4/2015 |

OTHER PUBLICATIONS

Cold-Formed Structural Framing Products Technical Design Guide, ClarkDietrich Buiding Systems, 2012, 105 pages.
ClarkDietrich Product Information, May 2014, 1 page.
Trakloc(R) Drywall Framing System, ClarkDietrich Building Systems, http://www.clarkdietrich.com/products/drywall-framing/trackloc-drywall-framing-system, Jun. 2, 2017, 3 pages.
Trex Elevations(R) Steel Deck Framing with Transcend Decking in Tree House, Trex, http://www.trex.com/products/deck-framing-drainage/elevations/, Jun. 2, 2017, 22 pages.

* cited by examiner

SYSTEMS AND METHODS FOR FRAMING COMPONENTS INCLUDING BRACKETS WITH FLEX-FIT FLANGES

CROSS REFERENCE TO RELATED APPLICATIONS

This is a non-provisional application that claims benefit to U.S. provisional application Ser. No. 62/403,936 filed on Oct. 4, 2016, and U.S. provisional application Ser. No. 62/454,378 filed on Feb. 3, 2017, which are herein incorporated by reference in their entirety.

FIELD

The present disclosure generally relates to systems and methods for interlocking brackets; and in particular, to systems and methods of manufacturing and configuring specialized interlocking brackets for a framing assembly.

BACKGROUND

Conventional framing assemblies and systems are complicated, burdensome, and difficult to deploy on-site and have consequently failed to satisfy the needs of users in the construction and general framing industries. For example, conventional framing assemblies often require structural connections to be made to an open side, external side, or outside portion of a joist or stud. Such connections may require additional connecting components or sleeves which can move the connecting point outside the edges of a connecting joist. One particular conventional framing assembly involves sleeves or tracks that attach to the outside of the joist and are implemented to connect adjacent joists. The attachment of tracks or sleeves on the outside of the joist creates an elevated component or surface which can be detected and can lead to framing complications. Additional tedious manufacturing steps may be involved when dealing with an elevated portion of a framing assembly which is time consuming and reduces the speed and efficiency of construction.

It is with these observations in mind, among other, that various aspects of the present disclosure were conceived and developed.

SUMMARY

A need exists for an improved framing assembly and methods of making the same. Accordingly, one embodiment of the present disclosure may take the form of a system for interlocking framing components, comprising a joist comprising a web in communication with a first joist flange and an opposite second joist flange that collectively define a joist interior portion. The system includes a bracket configured to be disposed within the joist interior portion and engaged to the first and second joist flanges, respectively, the bracket comprising a first bracket section in communication with a second bracket section, a bracket bend defined between the first and second bracket sections, the first bracket section defining a base, a first lateral wing, and an opposing second lateral wing extending outwardly from opposite sides of the base of the first bracket section, wherein the first bracket section is aligned in perpendicular relation relative to the second bracket section.

Another embodiment of the present disclosure may take the form of a first bracket section, comprising: a base, a first lateral wing of the first bracket section extending outwardly from a first side of the base, and a second lateral wing extending outwardly from a second side of the base opposite the first side, the first lateral wing and the second lateral wing configured to flex relative to the base; and a second bracket section, the second bracket section aligned in perpendicular relation relative to the first bracket section along a bracket bend Another embodiment of the present disclosure may take the form of a method, comprising the steps of: providing a joist comprising a web in communication with a first joist flange and an opposite second joist flange that collectively define a joist interior portion; inserting a bracket within the joist interior portion at an angle relative to a longitudinal axis of the joist, the bracket comprising a first bracket section in communication with a second bracket section and a bracket bend defined between the first and second bracket sections, the first bracket section defining a base, a first lateral wing, and an opposing second lateral wing extending outwardly from opposite sides of the base; and positioning the base of the first bracket section along the web of the joist such that the first lateral wing contacts the first joist flange and the second lateral wing contacts the second joist flange.

BRIEF DESCRIPTION OF THE DRAWINGS

The foregoing and other objects, features, and advantages of the present disclosure set forth herein should be apparent from the following description of particular embodiments of those inventive concepts, as illustrated in the accompanying drawings. Also, in the drawings the like reference characters refer to the same parts throughout the different views. The drawings depict only typical embodiments of the present disclosure and, therefore, are not to be considered limiting in scope.

DETAILED DESCRIPTION

Figure 1:
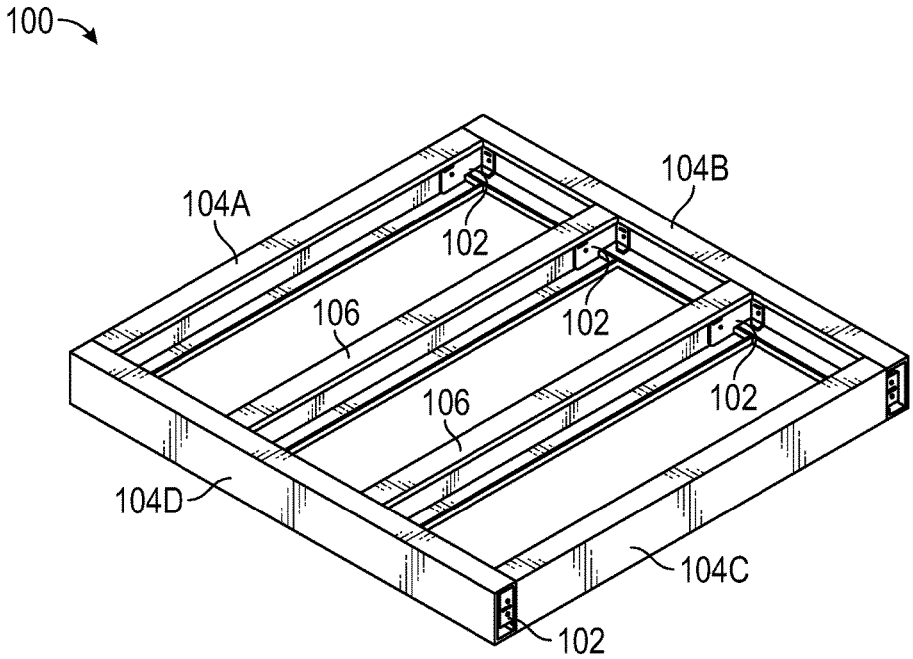
FIG. 1 is a perspective view of framing assembly comprising a plurality of brackets mechanically coupled to a plurality of joists, according to aspects of the present disclosure.

Aspects of the present disclosure relate to a framing assembly which may include a plurality of framing components such as brackets, joists, studs, end rails, side rails, interior sleeves, inserts, and the like. A bracket, in particular, may be implemented to interconnect adjacent components of the framing assembly. One embodiment of the bracket for use with the framing assembly may include a first bracket section in communication with a second bracket section. A bracket bend may be defined between the first bracket section and the second bracket section of the bracket such that the first bracket section is aligned in perpendicular relation relative to the second bracket section along the bracket bend. In addition, first and second flexible lateral wings may extend from opposite sides of the first bracket section and may be configured to be received within an interior portion of the joist as further described herein. In some embodiments, the flexible lateral wings of the brackets may be configured with a predetermined degree of flex capability, i.e., can temporarily bend inwards to allow each of the brackets to fit inside interior portions of a joist, as further described herein.

In many embodiments, the brackets may be joined at any point along the length of the joist using a snap-in engagement in which the bracket is initially inserted within the joist interior portion at an angle and then turned relative to the joist such that the bracket is aligned along the longitudinal axis of the joist and snaps into place as the opposite lateral wings of the bracket each respectively flex inwardly and engage surfaces of the joist interior portion, as further described herein. Referring to the drawings, embodiments for a framing system for interconnecting framing components together are illustrated and generally indicated as 100 in FIGS. 1-12.

Figure 2:
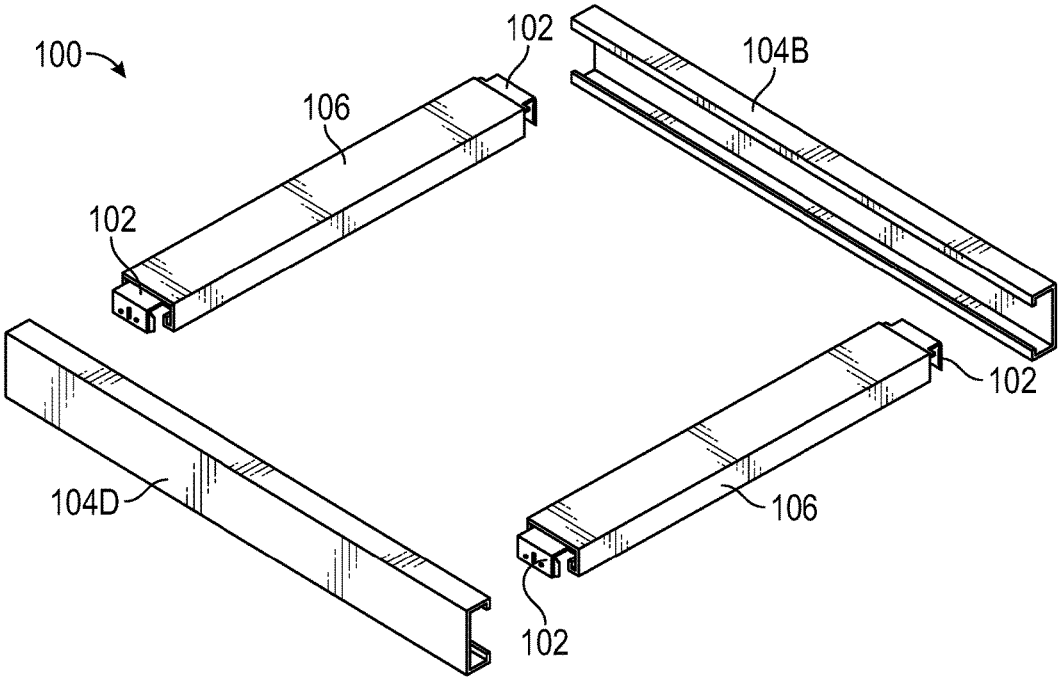
FIG. 2 is an exploded perspective view of the framing assembly of FIG. 1, according to aspects of the present disclosure.

Referring to FIGS. 1 and 2, a first embodiment of the framing assembly 100 may include one or more brackets 102 configured to be engaged and secured to one or more joists 104 and/or joists 106. In some embodiments, the framing assembly 100 may include one or more studs (not shown) defining a shape substantially similar or identical to the joists 104 and joists 106 with the studs extending in a vertical orientation as opposed to the horizontal orientation of the joists 104 and joists 106 shown. Studs may be implemented as vertically extending members of the framing assembly 100 to form e.g. vertical walls; and the joists 104 and joists 106 may comprise horizontal members implemented to form ceilings, roofs, decks, flooring, or any other like horizontal surface.

As shown, the joists 104 may include joists 104A, 104B, 104C, and 104D which may define respective sides of the framing assembly 100 and otherwise define a boundary or perimeter of the framing assembly 100. The joists 104A and 104C may define opposing end rails of the framing assembly, the joists 104B and 104D may define opposing side rails of the framing assembly 100, and the joists 106 may extend lengthwise in parallel orientation between the joist 104B and the joist 104D. The brackets 102 may be implemented to interlock or connect any of the joists 104 and 106 as described herein. The framing assembly 100 is not limited to the rectangular configuration shown and may define different shapes and orientations depending upon the particular application and framing components involved. Further, the framing assembly 100 is not limited to the aforementioned framing components disclosed and additional framing components are contemplated.

Figure 3:
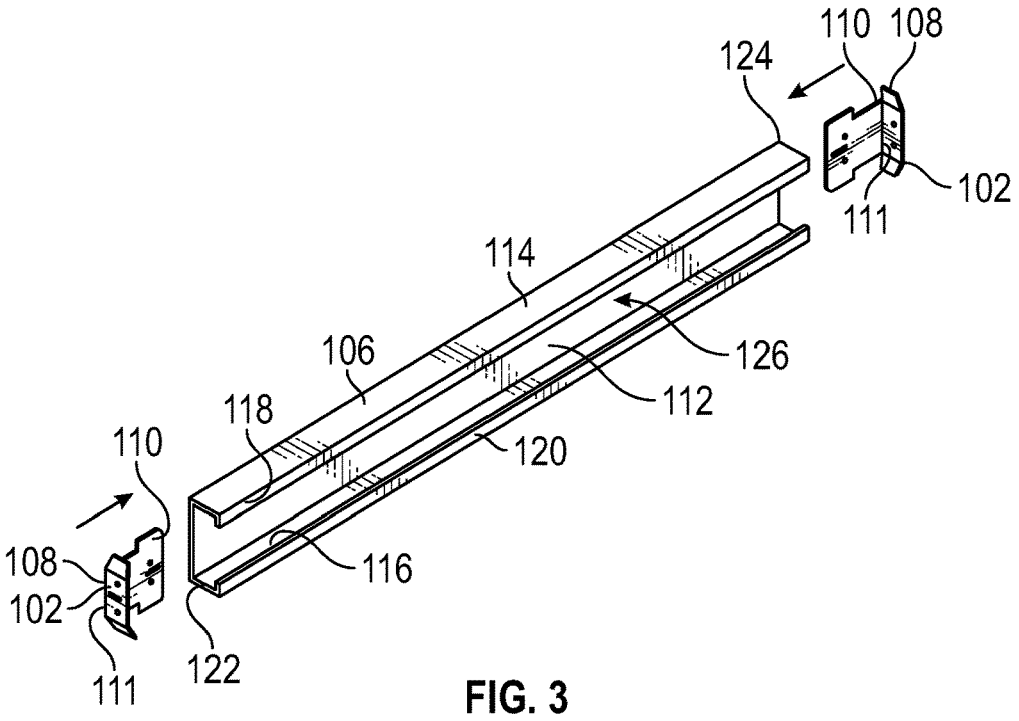
FIG. 3 is an exploded view of a portion of the framing assembly of FIG. 1 showing the brackets of FIG. 8 being engaged to opposite ends of a joist, according to aspects of the present disclosure.
Figure 4:
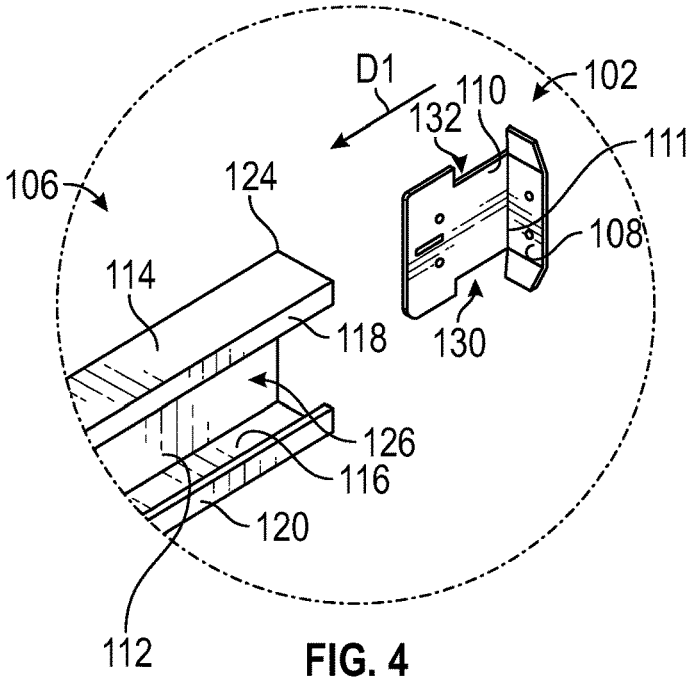
FIG. 4 is an enlarged view of one of the brackets of FIG. 3 illustrating one sequence for engaging the bracket to one end of a first joist, according to aspects of the present disclosure.
Figure 5:
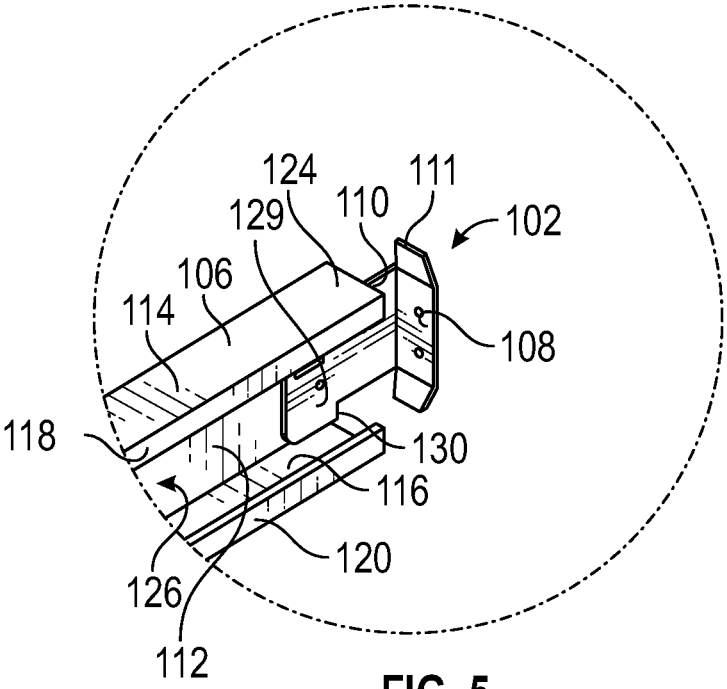
FIG. 5 is an enlarged view of the bracket of FIG. 4 illustrating the engagement of the bracket at one end of the first joist, according to aspects of the present disclosure.

Referring to FIGS. 3-5, the brackets 102 may be mechanically engaged, coupled, or otherwise connected to a joist 106 to form a portion of the framing assembly 100. As shown, the brackets 102 may generally define a first bracket section 108 and a second bracket section 110 in communication with the first bracket section 108 along a bracket bend 111. As shown in FIG. 4, the brackets 102 may further define a first notch 130 defined along a first side of the second bracket section 110 and a second notch 132 defined along a second side of the second bracket section 110 opposite the first notch 130. The joist 106 may include an elongated body defining a web 112 or middle portion, a flange 114 formed along a first side of the web 112, and a flange 116 formed along a second side of the web 112 opposite the flange 114. The joist 106 further comprises opposing returns 118 and 120 defined along the edges of the flanges 114 and 116 respectively. The returns 118 and 120 extend orthogonally from the edges of the flange 114 and the flange 116, respectively, such that the joist 106 defines a general C-shape configuration. The joist 106 further comprises a joist interior portion 126 defined collectively by the space between the web 112, the flanges 114 and 116, and the returns 118 and 120. The joist interior portion 126 generally defines a slot or cavity for receiving the second bracket section 110. In other words, the second bracket section 110 may be slidably inserted or positioned within the joist interior portion 126 of the joist 106 as indicated and described herein.

Referring to FIG. 3, in some embodiments, a pair of the brackets 102 may be partially engaged within the joist interior portion 126 at respective ends 122 and 124 of the joist 106 to form part of the framing assembly 100. To further illustrate for example, FIGS. 4-5 show the connection between a bracket 102 and an end 124 of the joist 106 by inserting the second bracket section 110 of the bracket 102 along the direction shown to within the joist interior portion 126.

As shown in FIG. 2 and FIG. 5, the first bracket sections 108 of the respective brackets 102 extend outwardly from the joist 106 such that the first bracket sections 108 remains accessible for connection with other joists or framing components of the framing assembly 100, as described herein. As further shown, a portion of the second bracket sections 110 of the brackets 102 overlaps the web 112 of the joist 106. Accordingly, the brackets 102 connect to the joist 106 from the interior side; i.e., within the joist interior portion 126 of the joist 106 as opposed to an exterior side. This particular configuration, engaging the brackets 102 within the joist interior portion 126, reduces and/or eliminates the need for excess or an undesired amount of additional structure to be mounted to exterior surfaces of the joist 106 to connect the joist to the bracket 102, thereby improving upon conventional framing assemblies.

Figure 6:
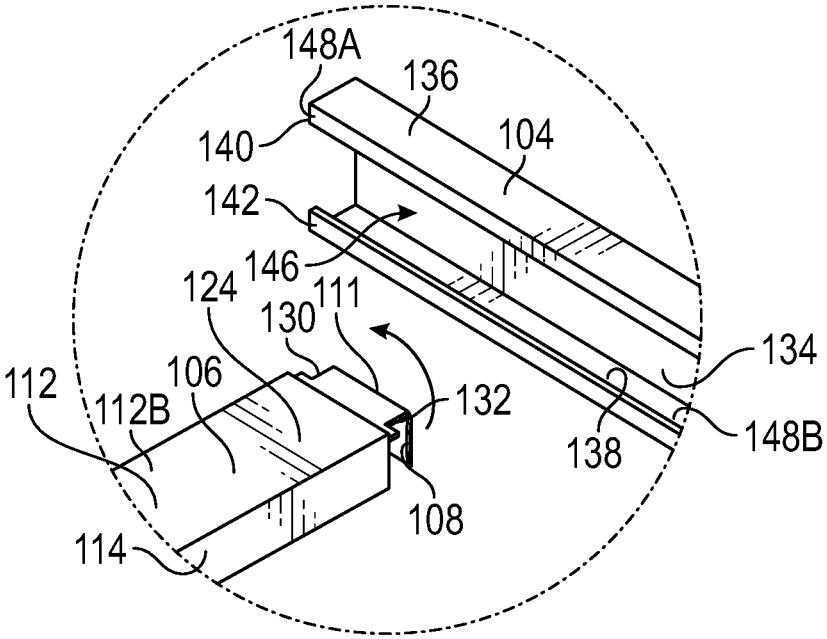
FIG. 6 is an enlarged view of the bracket of FIG. 4 illustrating one sequence for the engagement of the bracket to a second joist, according to aspects of the present disclosure.
Figure 7:
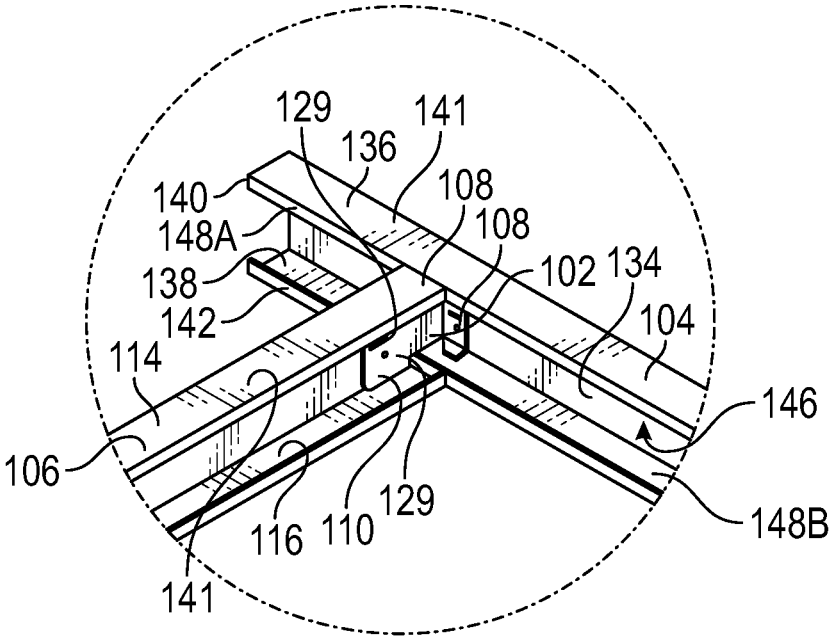
FIG. 7 is an enlarged view of the bracket of FIG. 4 illustrating the engagement of the bracket to a second joist, according to aspects of the present disclosure.

Referring to FIGS. 6-7, a joist 106, having a bracket 102 engaged at an end 124 of the joist 106 in a manner as described in FIGS. 3-5, may be engaged to a joist 104, such as the joist 104B of FIG. 1, to continue forming the framing assembly 100. The joist 104, similar or identical to the joist 106, may include a web 134, a flange 136 defined along a first side of the web 134, a flange 138 defined along a second side of the web 134 opposite the flange 136, a return 140 defined along the flange 136, and a return 142 defined along the flange 138 opposite the return 140. The web 134, flanges 136 and 138, and returns 140 and 142 of the joist 104 collectively define a joist interior portion 146 configured for receiving portions of the bracket 102 such as the first bracket section 108.

In some embodiments, the end 124 of the joist 106 of FIG. 6 may be positioned towards the web 134 of the joist 104 with an external surface 112B (FIG. 6) of the web 112 of the joist 106 oriented in an upwards position, and the first bracket section 108 oriented in a downwards position, as shown. The first bracket section 108 and the joist 106 may be inserted within the joist interior portion 146 of joist 104 and then rotated in the manner indicated to mechanically couple, snap-lock, connect, or otherwise engage the joist 106 to the joist 104, as further described herein. The first bracket section 108 may be positioned within the joist interior portion 146 anywhere along a length of the joist 104 between a first end 148A and a second end 148B of the joist 104.

As shown in FIG. 7, upon rotating and engaging the joist 106 to the joist 104 as shown, the flange 136 of the joist 104 is flush with the flange 114 of the joist 106. Likewise, the flange 116 of the joist 106 is flush with the flange 138 of the joist 104. As a result, for example, a top surface 141 is defined collectively by top/exterior surfaces (not shown) of the flange 136 and the flange 114. The top surface 141 may extend horizontally and may be flat, planar, and otherwise uninterrupted which is important for most builders. The top surface 141 may be suitable for mounting of a flooring component, a deck, or the like thereto and is otherwise readily usable; i.e., devoid of interrupting fastening components such as screws or elevated portions. The disclosed connections contrast with many conventional framing assemblies which generally involve connecting a first joist to a second joist by connecting the first joist and the second joist to a track, with the track extending over exterior surfaces of the first joist and the second joist. These conventional framing assemblies involve an overall height increase, interrupt the top plane between the first joist and the second joist, and may require screws, bolts, or other fastening components to be implemented along the top surface, further interrupting any conventional top surface. Conventional framing assemblies therefore lack the top surface 141 of FIG. 7 (and may lack the corresponding flat bottom surface defined by the flange 116 of the joist 106 and the flange 138 of the joist 104) which may allow a builder to efficiently adjoin structure thereto without additional finishing steps such as the removal of screw heads or otherwise preparing the top surface 141 for e.g., the attachment of flooring beams, a deck, or the like. While FIGS. 6-7 illustrate engagement of the bracket 102 to the joist 104 after the second bracket section 110 of the bracket 102 is connected to the joist 106, engagement of the bracket 102 to the joist 104 may occur simultaneously with or before the bracket 102 is engaged to the joist 106, and the present disclosure is not limited in this regard.

Figure 8A:
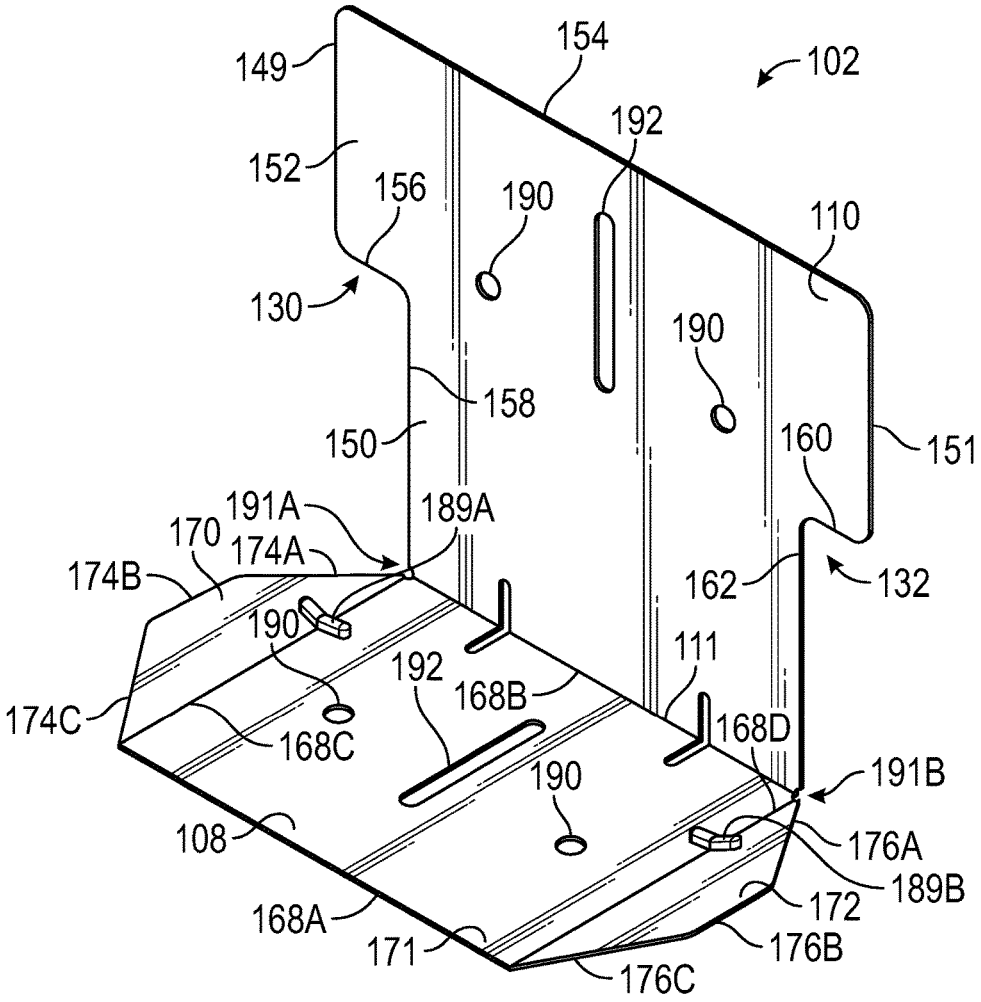
FIG. 8A is a perspective view of one embodiment of a bracket for use with the framing assembly described herein, according to aspects of the present disclosure.
Figure 8B:
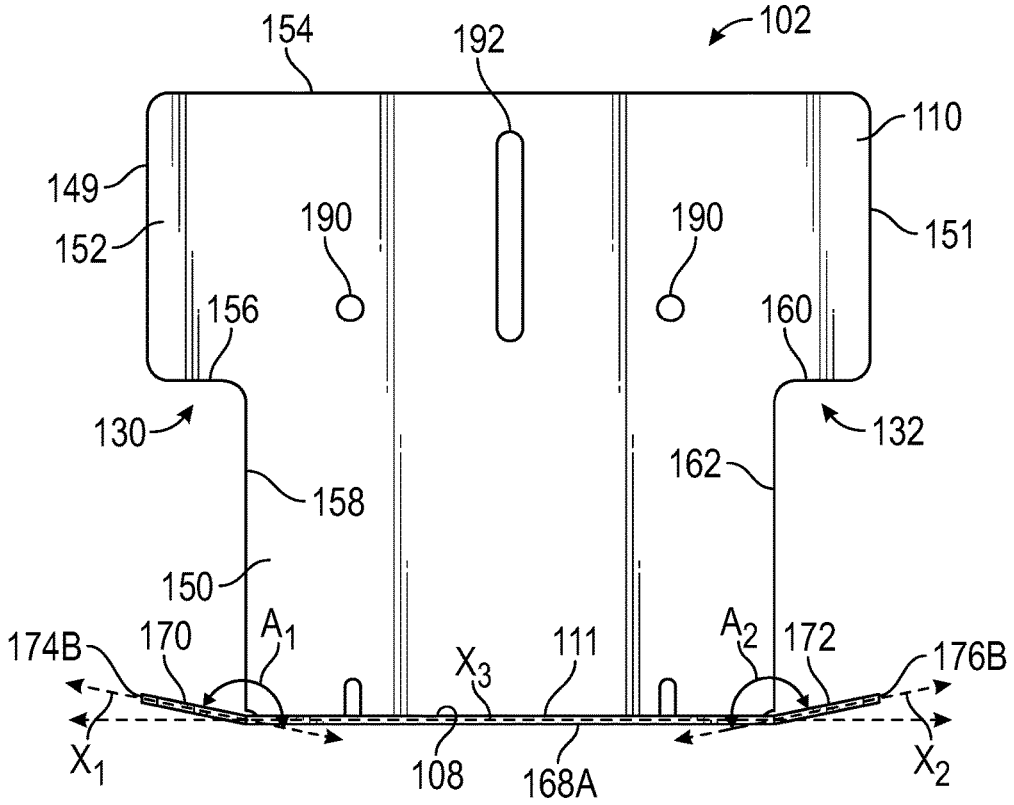
FIG. 8B is a front view of the bracket of FIG. 8A for use with the framing assembly described herein, according to aspects of the present disclosure.
Figure 8C:
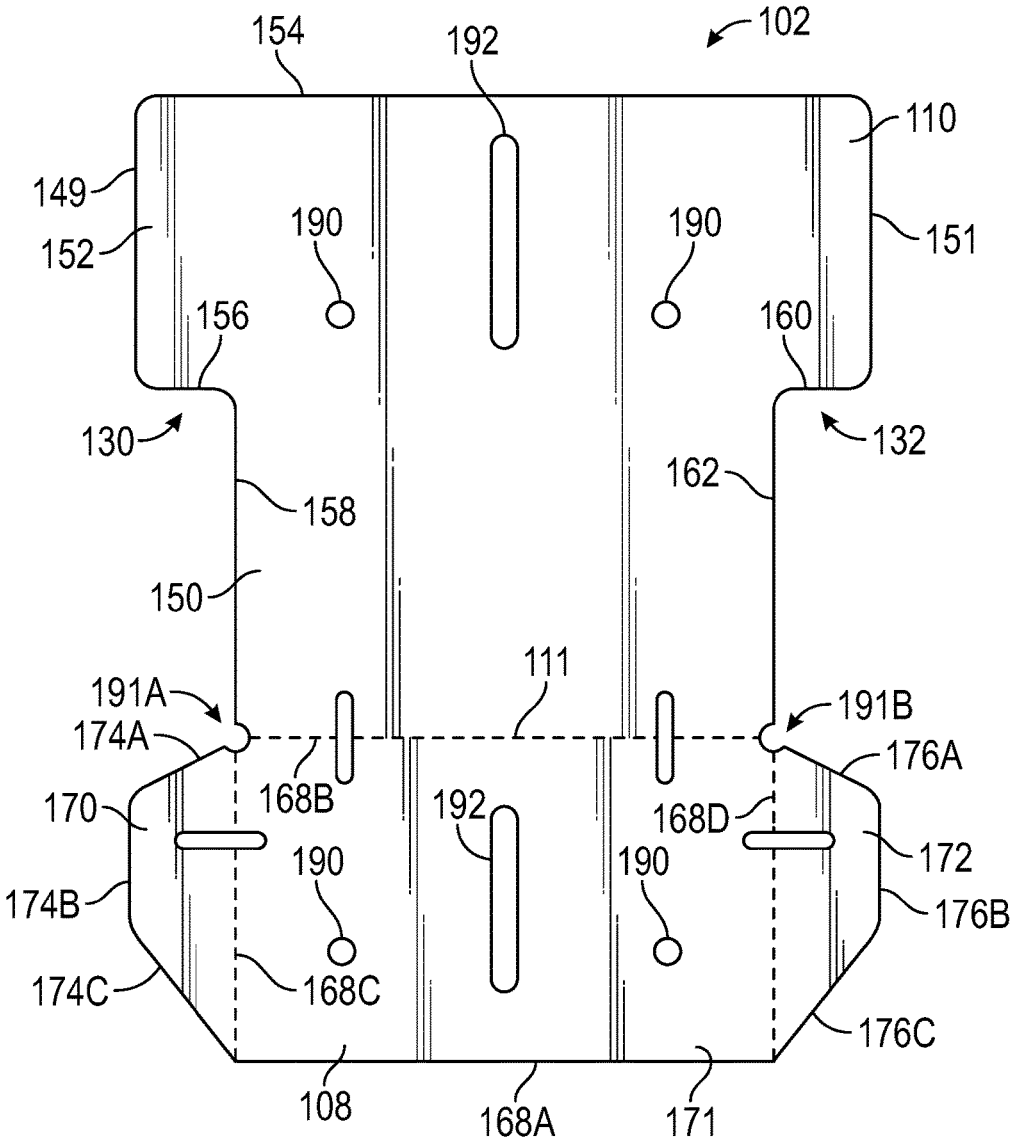
FIG. 8C is a plan view of the bracket of FIG. 8A, according to aspects of the present disclosure.

Referring to FIGS. 8A-8C, one embodiment of the bracket 102 is shown for connecting together the joists 104 and 106 of the framing assembly 100. The bracket 102 includes the first bracket section 108, and the bracket 102 includes the second bracket section 110 in communication with the first bracket section 108 along the bracket bend 111. In some embodiments, the first bracket section 108 is aligned in perpendicular relation relative to the second bracket section 110 along the bracket bend 111 such that the bracket 102 defines a general L-shaped configuration or 90 degree bracket. In some embodiments, the bracket bend 111 of the bracket 102, or more particularly, the orientation of the first bracket section 108 relative to the second bracket section 110 may vary such that the bracket 102 may define configurations other than a 90 degree bracket. For example, the orientation of the first bracket section 108 relative to the second bracket section 110 along the bracket bend 111 may be such that the bracket 102 may define a configuration in the range of 0-60 degrees, 60-90 degrees, 90-120 degrees, and 120 to 150 degrees, and the like. In other embodiments, the second bracket section 110 may be twisted laterally relative to the first bracket section 108 to address different variations of the framing assembly 100 as would be appreciated by one skilled in the subject art.

In some embodiments, the second bracket section 110 of the bracket 102 includes a first side 149, a second side 151, and a top side 154. Further, the second bracket section 110 may define a first portion 150 and a second portion 152 in communication with the first portion 150. The first portion 150 may be defined along the bracket bend 111 and the second portion 152 may be defined along the first portion 150 as shown. In some embodiments, the second portion 152 defines a width greater than a width of the first portion 150 of the second bracket section 110 which may be more suitable for engagement to a joist.

By virtue of the dimensions of the first portion 150 and the second portion 152 of the second bracket section 110 shown, the bracket 102 includes a first notch 130 defined along the first side 149 of the second bracket section 110, and a second notch 132 defined along the second side 151 of the second bracket section 110 opposite the first notch 130. The first notch is defined by a bottom edge 156 of the second portion 152 and a side edge 158 of the first portion 150 of the second bracket section 110. The second notch is defined by a bottom edge 160 of the second portion 152 and a side edge 162 of the first portion 150 of the second bracket section 110.

As shown, the first bracket section 108 includes a base 171 and first and second lateral wings 170 and 172 that extend outwardly at an angle relative to the base 171. The base 171 may be defined by a plurality of sides 168A-168D of the first bracket section 108 as shown. The base 171 may be substantially planar or flat and may otherwise extend orthogonally relative to the second bracket section 110 along the bracket bend 111. The first lateral wing 170 may be defined along the side 168C of the first bracket section 108. The second lateral wing 172 may be defined along the side 168D of the first bracket section 108. As shown in FIG. 8B, the first lateral wing 170 is aligned along an axis X1, which forms an angle A1 relative to the longitudinal axis X3 of the base 171, while the second lateral wing 172 is aligned along an axis X2, which forms an angle A2 relative to the longitudinal axis X3 of the base 171. In many embodiments, angles A1 and A2 defined by the first and second lateral wings 170 and 172 are the same angle and are generally obtuse.

The first lateral wing 170 is configured to flex or bend inwardly in a vertical direction, along the side 168C of the first bracket section 108 relative to the axis X3 defined by the base 171 which results in a reduction to the angle A1. Similarly, the second lateral wing 172 is configured to flex or bend inwardly in a vertical direction; along the side 168D of the first bracket section 108 relative to the axis X3 defined by the base 171 which results in a reduction to the angle A2. This flex feature of the first and second lateral wings 170 and 172 accommodates the engagement of the bracket 102 within a joist interior portion, as shall be discussed in greater detail below.

In some embodiments, the first lateral wing 170 may define a plurality of outer edges 174A-174C. Similarly, the second lateral wing 172 may defined a plurality of outer edges 176A-176C. In some embodiments, each of the plurality of outer edges 174A-174C and the plurality of outer edges 176A-176C may be linear and devoid of curvature. As shown, in some embodiments, the first lateral wing 170 and the second lateral wing 172 may define general trapezoidal-shapes, by virtue of the dimensions of the plurality of outer edges 174A-174C and the plurality of outer edges 176A-176C, respectively shown. The plurality of outer edges 174A-174C and the plurality of outer edges 176A-176C may scrape against the inside of a joist (such as the inside surface of a joist's flanges) to hold the bracket 102 in place within a joist interior portion until screws or other permanent securing members can be implemented, as further described herein. Screws, bolts, or other securing members may be applied through either of openings 190 and/or slots 192 formed along portions of the bracket 102 as shown. In some embodiments, the first bracket section 108 of the bracket 102 may include a first axial recess 191A and a second axial recess 191B which may assist with bending of the first and second lateral wings 170 and 172 respectively. In some embodiments, bumps 189A and 189B may be formed along the side 168C and the side 168D respectively as shown in FIG. 8A. The bumps 189A/B may be formed of a metal or steel and may cause resistance to the bending or flexing of the wings 170 and 172 described. Such reinforcement, and resistance to the bending or flexing of the wings 170 and 172 may accommodate a tighter fit of the bracket 102 along a joist.

Figure 9A:
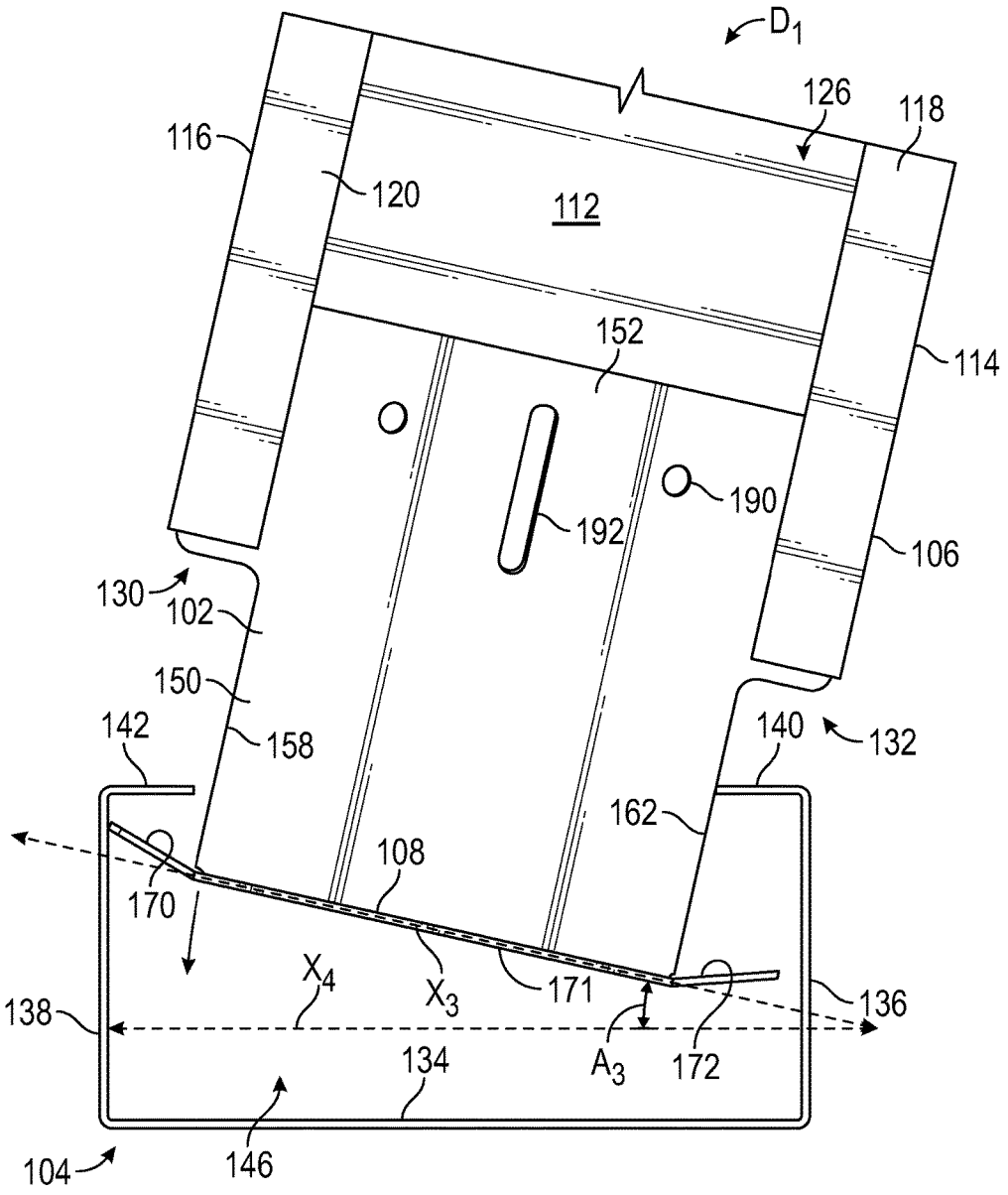
FIG. 9A illustrates one sequence of engaging the bracket of FIG. 8A to a joist, according to aspects of the present disclosure.
Figure 9B:
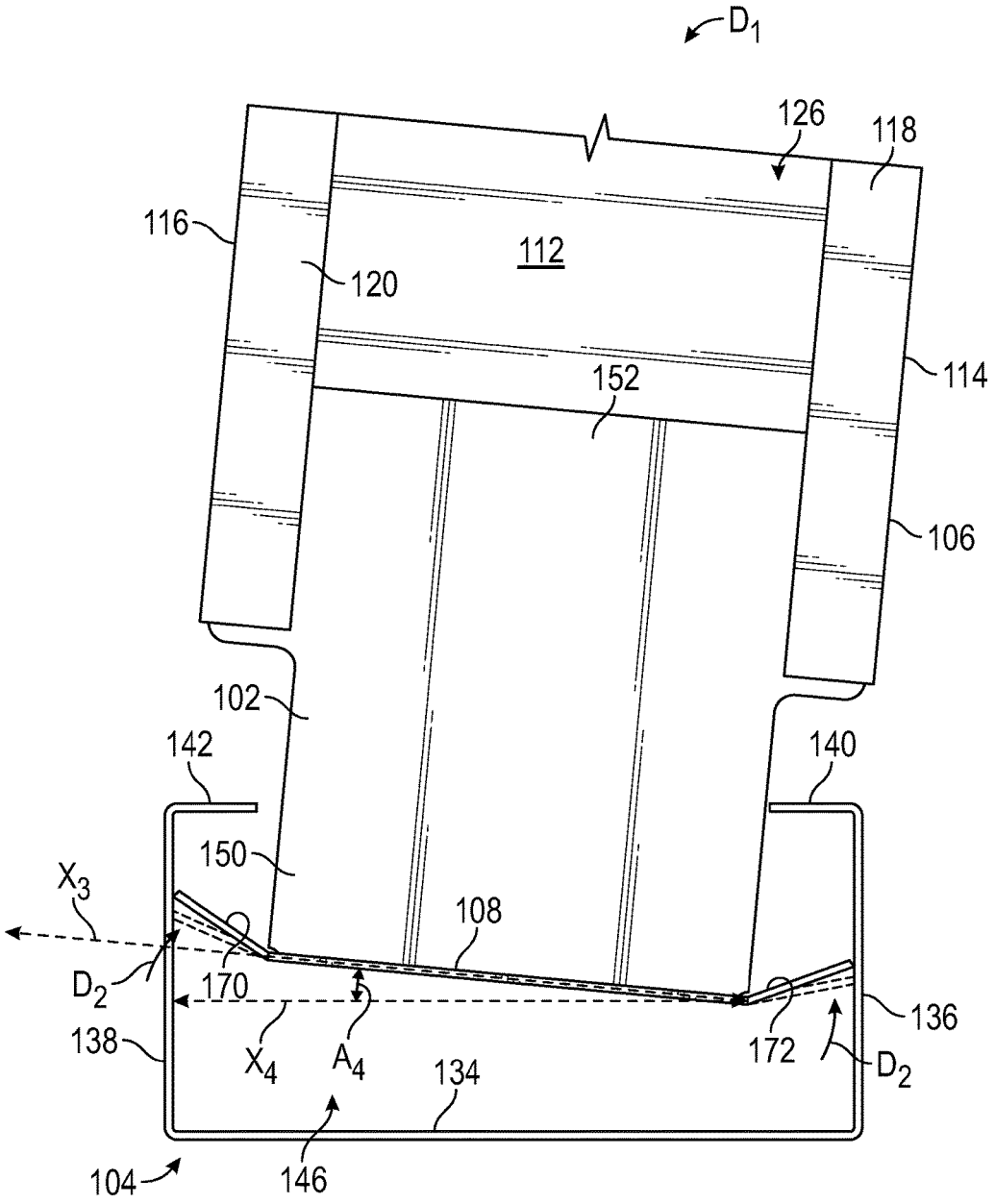
FIG. 9B illustrates another sequence of engaging the bracket of FIG. 8A to a joist, according to aspects of the present disclosure.
Figure 9C:
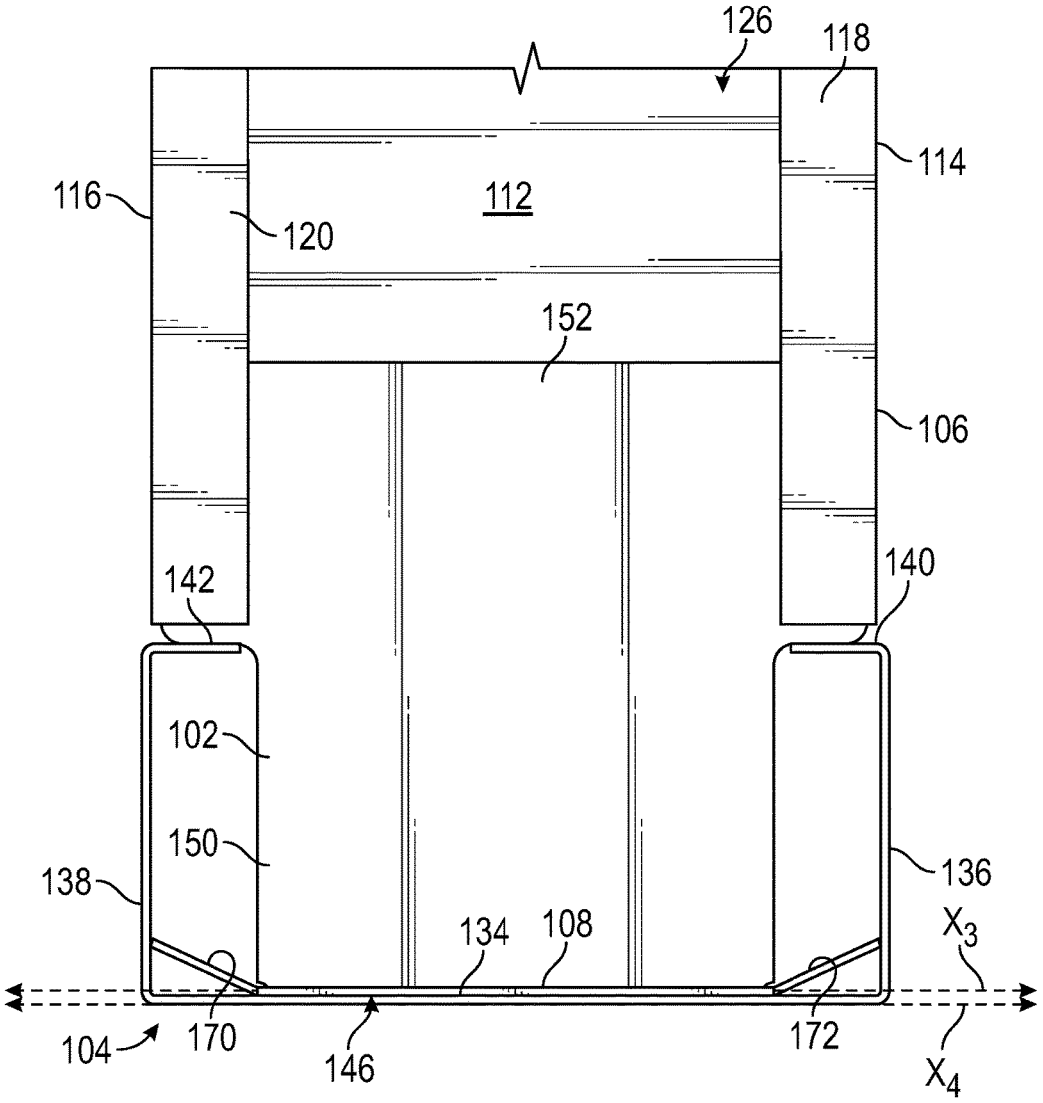
FIG. 9C illustrates another sequence of engaging the bracket of FIG. 8A to a joist, according to aspects of the present disclosure.

Referring to sequences illustrated in FIGS. 9A-9C respectively, one method for coupling the bracket 102 to the joist 104 shall now be discussed. As shown, the bracket 102 is initially disposed within the joist interior portion 146 at an angle; specifically, such that the axis X3 of the base 171 is oriented at an angle A3 relative to the latitudinal axis X4 of the joist 104. In this orientation, a peripheral portion of the first lateral wing 170 is in contact with or at least in close proximity to the flange 138 of the joist 104. As further indicated the bracket 102 may then be shifted in a direction D1 towards the web 134 of the joist 104. Inserting the bracket 102 within the joist interior portion 146 of the joist 104 at an angle as depicted may be advantageous for maneuvering the first lateral wing 170 and the second lateral wing 172 beyond the return 140 and the return 142.

Referring to FIG. 9B, a downward force may be applied to the bracket 102 along the direction D1 to pass the bracket 102 to the orientation shown and cause the base 171 of the first bracket section 108 to rotate as indicated towards the web 134 of the joist 104. In some embodiments, the width of the first bracket section 108 defined by the base 171, the first lateral wing 170, and the second lateral wing 172 may be slightly greater than a width of the joist interior portion 146, or the width between the flange 136 and the flange 138. Consequently, as shown, the first lateral wing 170 contacts and scrapes against interior surfaces of the flange 138 and the second lateral wing 172 contacts and scrapes against interior surfaces of the flange 136 as the wider first bracket section 108 is brought to within the joist interior portion 146. As the downward force is applied, the first lateral wing 170 bends or flexes inwardly towards the base 171 relative to the side 168C in a direction D2, and the second lateral wing 172 bends or flexes inwardly relative to the side 168D in the direction D2 away from the web 134 of the joist 104. The flexing or bending of the first lateral wing 170 inwardly relative to the side 168C and the flexing or bending of the second lateral wing 172 inwardly relative to the side 168D reduces the angle A1 and the angle A2 and at least temporarily changes the orientations of the first lateral wing 170 and the second lateral wing 172 relative to the base 171. Such changes with respect to the orientations of the first lateral wing 170 and the second lateral wing 172 respectively may decrease the width of the first bracket section 108 defined by the base 171, the first lateral wing 170, and the second lateral wing 172 as shown, thereby accommodating the continued movement of the bracket 102 further down within the joist interior portion 146 towards the web 134. In some embodiments, a thickness of the bracket 102 may be slightly decreased along portions of the first bracket section 108 between the base 171 and the first and second lateral wings 170 and 172, to facilitate the bending of the first lateral wing 170 and the second lateral wing 172 as described; although the bracket 102 is not limited to this aspect. In other embodiments, the first bracket section 108 may be formed of a different material, such as spring steel, which includes generally includes metals which tend to return to an original position or shape despite bending, twisting, or flexing.

As the first lateral wing 170 and the second lateral wing 172 bend or flex as described, the plurality of outer edges 174A-174C and the plurality of outer edges 176A-176C dig into the inside surfaces of the joist 104 along the flange 138 and the flange 136. As further shown in FIG. 9B, as the downward force is applied and the bracket 102 is shifted further towards the web 134 of the joist 104, an angle A4 is defined between the latitudinal axis X3 of the bracket 102 and the latitudinal axis X4 of the joist 104. The angle A4 may be less than the angle A3 illustrated in FIG. 9A as the base 171 rotates further towards the web 134.

Referring to FIG. 9C, the bracket 102 is passed further along the direction D1, and the base 171 is rotated towards the web 134 until the latitudinal axis X3 of the first bracket section 108 is aligned in parallel orientation with the latitudinal axis X4 of the joist 104. In some embodiments, the first bracket section 108 snaps into place within the joist interior portion 146 once the first lateral wing 170 and the second lateral wing 172 bend sufficiently inward towards the base 171 to accommodate the orientation shown. Further, once the bracket 102 is fully seated in the orientation shown, friction between the first lateral wing 170 and the flange 138 and friction between the second lateral wing 172 and the flange 136 maintain the bracket 102 in a fixed position relative to the joist 104 so that permanent securing members such as bolts or screws may be applied. In some embodiments, the flange 138 and the flange 136 may also bend laterally to accommodate the positioning of the bracket 102 within the joist interior portion 146 as described.

The bracket 102 as described above may be made with varying degrees of thickness about the first bracket section 108 to adjust the bending or flexing of the wings 170 and 172*b*. The length of the wings 170 and/or 172 may be lengthened, shortened, or otherwise be adjusted as needed to form a tighter fit within the joist interior portion 146 of the joist 104. Overall the wings 170 and 172 bend slightly to be able to create a tight fit and retain tension within the joist 104. The edges 174B and 176B may contact the interior surfaces of the joist walls in order to keep the bracket 102 from releasing from the joist. The dimensions of the bracket 102 may be adjusted as needed to accommodate different sized joists. The bumps 189A and 189B positioned within the corner of a bend defined along the side 168C and 168D may reinforce the wings 170 and 172 to cause greater tension between the wings 170 and 172 and the interior surfaces of the joist 104. In some embodiments, the edges 174B and 164B may include teeth or other surfaces to better grip the interior surfaces of the joist 104 and improve the mechanical connection and tension. Numerous other related features and embodiments are contemplated.

Figure 10A:
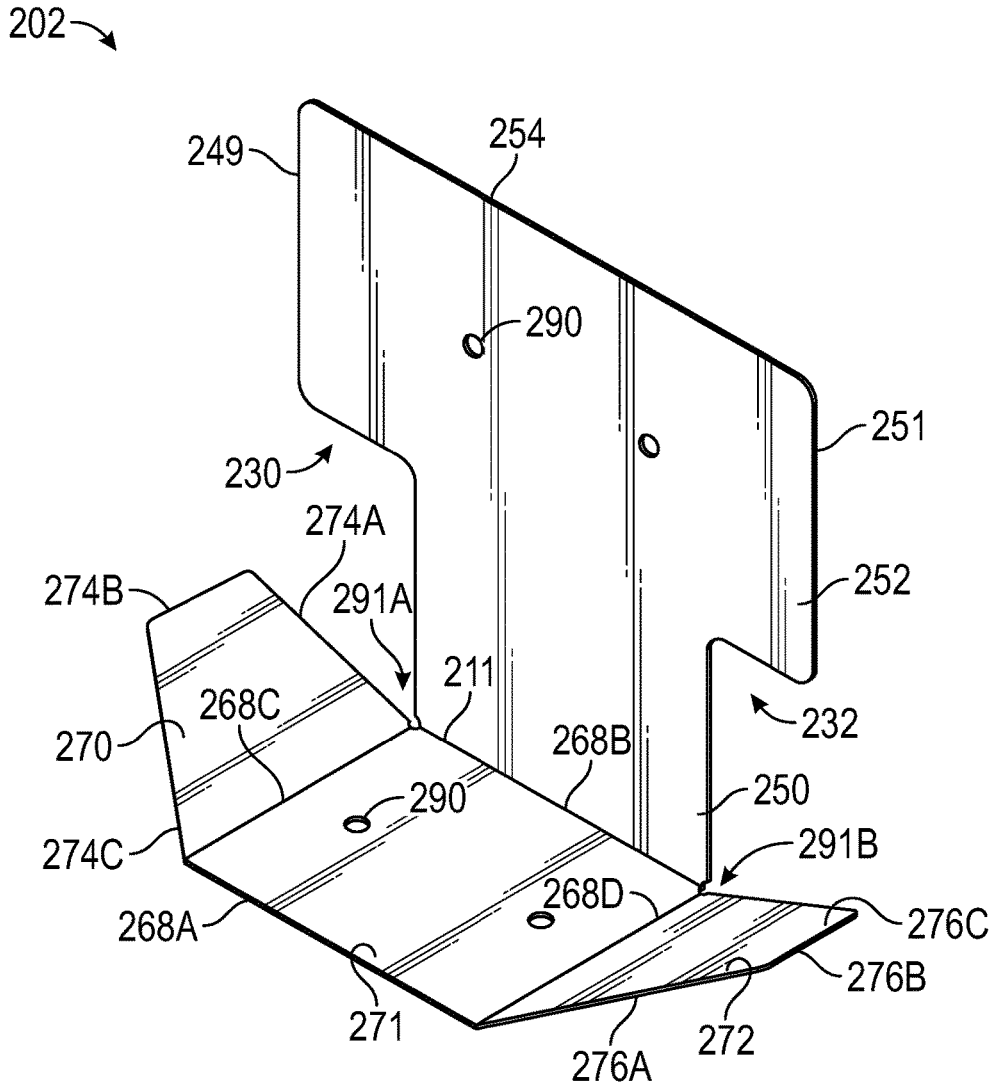
FIGS. 10A-10B illustrate a second embodiment of a bracket for use with the framing assembly, according to aspects of the present disclosure.
Figure 10B:
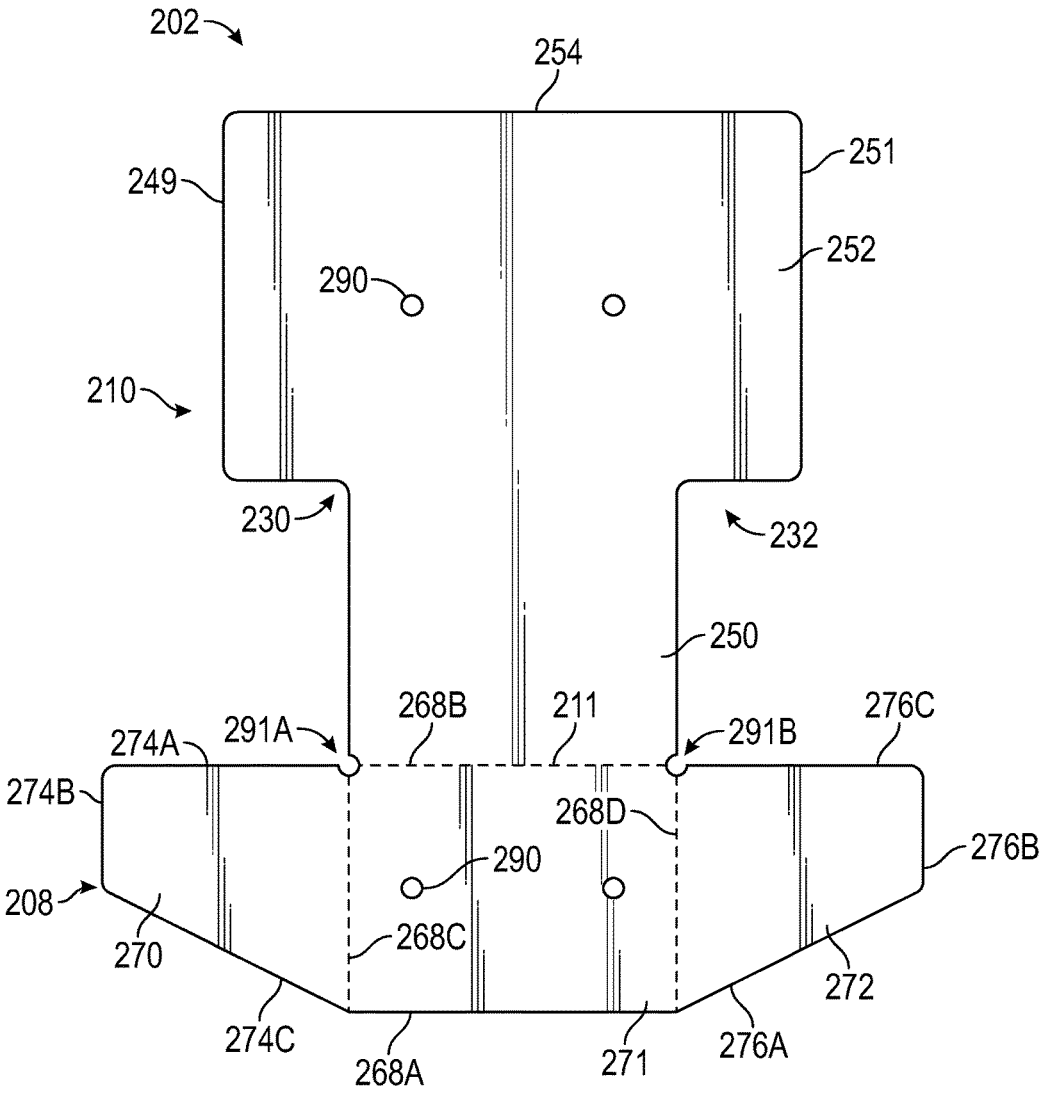

Referring to FIGS. 10A-10B, a second embodiment of a bracket 202 for use with the framing assembly 100 is illustrated. The bracket 202 includes a first bracket section 208, and the bracket 202 includes a second bracket section 210 in communication with the first bracket section 208 along a bracket bend 211. In some embodiments, the first bracket section 208 is aligned in perpendicular relation relative to the second bracket section 210 along the bracket bend 211 such that the bracket 202 defines a general L-shaped configuration or 90 degree bracket. In some embodiments, the bracket bend 211 of the bracket 202, or more particularly, the orientation of the first bracket section 208 relative to the second bracket section 210 may vary such that the bracket 202 may define configurations other than a 90 degree bracket. For example, the orientation of the first bracket section 208 relative to the second bracket section 210 along the bracket bend 211 may be such that the bracket 202 may define a configuration in the range of 0-60 degrees, 60-90 degrees, 90-120 degrees, and 120 to 150 degrees, and the like. In other embodiments, the second bracket section 210 may be twisted relative to the first bracket section 208 to address different variations of the framing assembly 100 as would be appreciated by one skilled in the relevant art.

In some embodiments, the second bracket section 210 of the bracket 202 includes a first side 249, a second side 251, and a top side 254. Further, the second bracket section 210 may define a first portion 250 and a second portion 252 in communication with the first portion 250. The first portion 250 may be defined along the bracket bend 211 and the second portion 252 may be defined along the first portion 250 as shown. In some embodiments, the second portion 252 defines a width greater than a width of the first portion 250 of the second bracket section 210 which may be more suitable for engagement to a joist. By virtue of the dimensions of the first portion 250 and the second portion 252 of the second bracket section 210 shown, the bracket 202 includes a first notch 230 defined along the first side 249 of the second bracket section 210, and a second notch 232 defined along the second side 251 of the second bracket section 210 opposite the first notch 230.

As shown, the first bracket section 208 includes a base 271 and first and second lateral wings 270 and 272 that extend outwardly at an angle relative to the base 271. The first bracket section further defines a plurality of sides 268A-2680. The base 271 may be substantially planar or flat and may otherwise extend orthogonally relative to the second bracket section 210 along the bracket bend 211. The first lateral wing 270, defined along the side 268C, is configured to flex or bend in a vertical direction, along the base 271. Similarly, the second lateral wing 272, defined along the side 268D, is configured to flex or bend in a vertical direction, along the base 271. As such, the first and second lateral wings 270 and 272 may be received within a joist interior portion, similar to the manner described in FIGS. 9A-9C.

In some embodiments, the first lateral wing 270 may define a plurality of outer edges 274A-274C. Similarly, the second lateral wing 272 may defined a plurality of outer edges 276A-276C. In some embodiments, each of the plurality of outer edges 274A-274C and the plurality of outer edges 276A-276C may be linear and devoid of curvature. As shown, in some embodiments, the first lateral wing 270 and the second lateral wing 272 may define general trapezoidal-shapes, by virtue of the plurality of outer edges 274A-274C and the plurality of outer edges 276A-276C, respectively. The plurality of outer edges 274A-274C and the plurality of outer edges 276A-276C may scrape against the inside of a joist such as the inside surface of a joist's flanges to hold the bracket in place within a joist interior portion until screws or other permanent securing members can be implemented, as further described herein. Screws, bolts, or other securing members may be applied through either of openings 290 shown.

In some embodiments, the bracket 202 differs from the bracket 102 because the first and second lateral wings 270 and 272 of the bracket 202 are more elongated or otherwise have greater respective lengths than the first and second lateral wings 170 and 172 of the bracket 102. Longer first and second lateral wings 270 and 272 may facilitate a more snug fit of the bracket 202 within a joist interior portion. In addition, the first bracket section 208 of the bracket 202 may include a first axial recess 291A and a second axial recess 291B which may assist with bending of the first and second lateral wings 270 and 272 similar to the bending or flexing of the first and second lateral wings 170 and 172 as described herein.

Figure 11A:
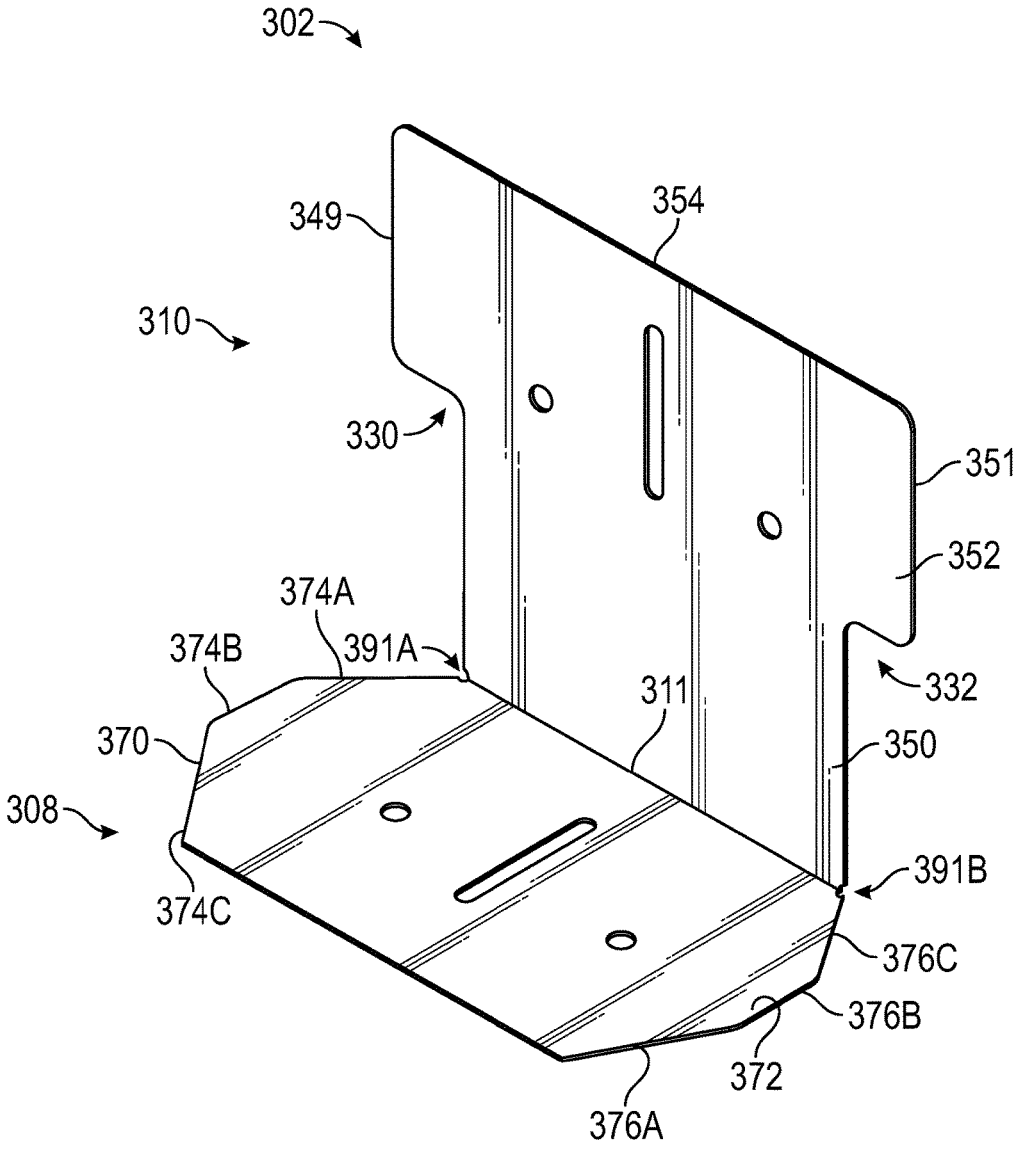
FIGS. 11A-11B illustrate a third embodiment of a bracket for use with the framing assembly, according to aspects of the present disclosure.
Figure 11B:
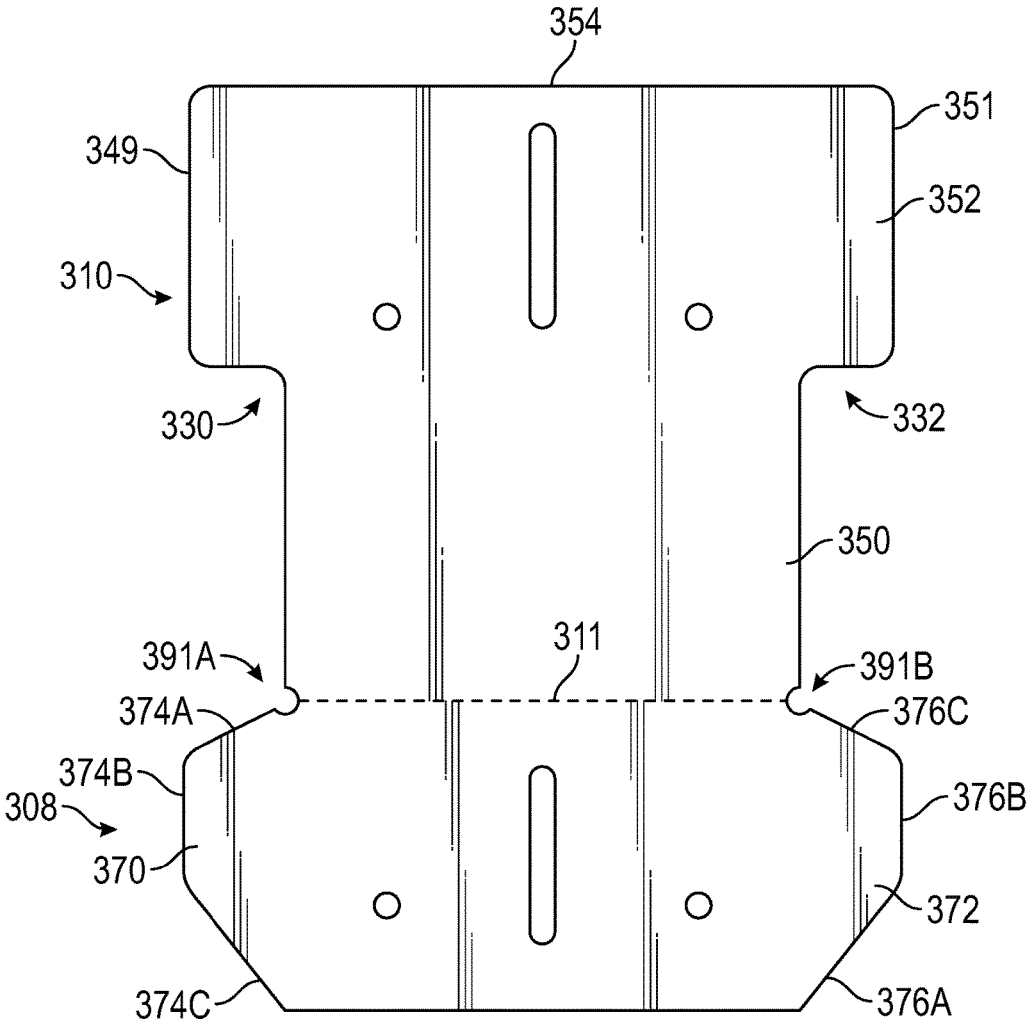

Referring to FIGS. 11A-11B, a third embodiment of a bracket 302 for use with the framing assembly 100 is illustrated. The bracket 302 includes a first bracket section 308, and the bracket 302 includes a second bracket section 310 in communication with the first bracket section 308 along a bracket bend 311. In some embodiments, the first bracket section 308 is aligned in perpendicular relation relative to the second bracket section 310 along the bracket bend 311 such that the bracket 302 defines a general L-shaped configuration or 90 degree bracket. In some embodiments, the bracket bend 311 of the bracket 302, or more particularly, the orientation of the first bracket section 308 relative to the second bracket section 310 may vary such that the bracket 302 may define configurations other than a 90 degree bracket. For example, the orientation of the first bracket section 308 relative to the second bracket section 310 along the bracket bend 311 may be such that the bracket 302 may define a configuration in the range of 0-60 degrees, 60-90 degrees, 30-60 degrees, 90 to 120 degrees, and 120 to 150 degrees, and the like. In other embodiments, the second bracket section 310 may be twisted relative to the first bracket section 308 to address different variations of the framing assembly 100 as would be appreciated by one skilled in the relevant art.

In some embodiments, the second bracket section 310 of the bracket 302 includes a first side 349, a second side 351, and a top side 354. Further, the second bracket section 310 may define a first portion 350 and a second portion 352 in communication with the first portion 350. The first portion 350 may be defined along the bracket bend 311 and the second portion 352 may be defined along the first portion 350 as shown. In some embodiments, the second portion 352 defines a width greater than a width of the first portion 350 of the second bracket section 310 which may be more suitable for engagement to a joist as described herein. By virtue of the dimensions of the first portion 350 and the second portion 352 of the second bracket section 310 shown, the bracket 302 includes a first notch 330 defined along the first side 349 of the second bracket section 310, and a second notch 332 defined along the second side 351 of the second bracket section 310 opposite the first notch 330.

In some embodiments, the bracket 302 differs from the bracket 102 as the entire first bracket section 308 may be substantially planar or flat and devoid of lateral wings. The first bracket section 308 may define a plurality of outer edges 374A-374C defined along a first side 370 of the first bracket section 308 and a plurality of outer edges 376A-376C defined along an opposing second side 372. In some embodiments, each of the plurality of outer edges 374A-374C and a plurality of outer edges 376A-376C may be linear and devoid of curvature. The plurality of outer edges 374A-374C and plurality of outer edges 376A-376C may scrape against the inside of a joist such as the inside surface of a joist's flanges to hold the bracket in place within a joist interior portion until screws or other permanent securing members can be implemented, as further described herein. In some embodiments, the first bracket section 308 of the bracket 302 may include a first axial recess 391A and a second axial recess 391B.

Figure 12A:
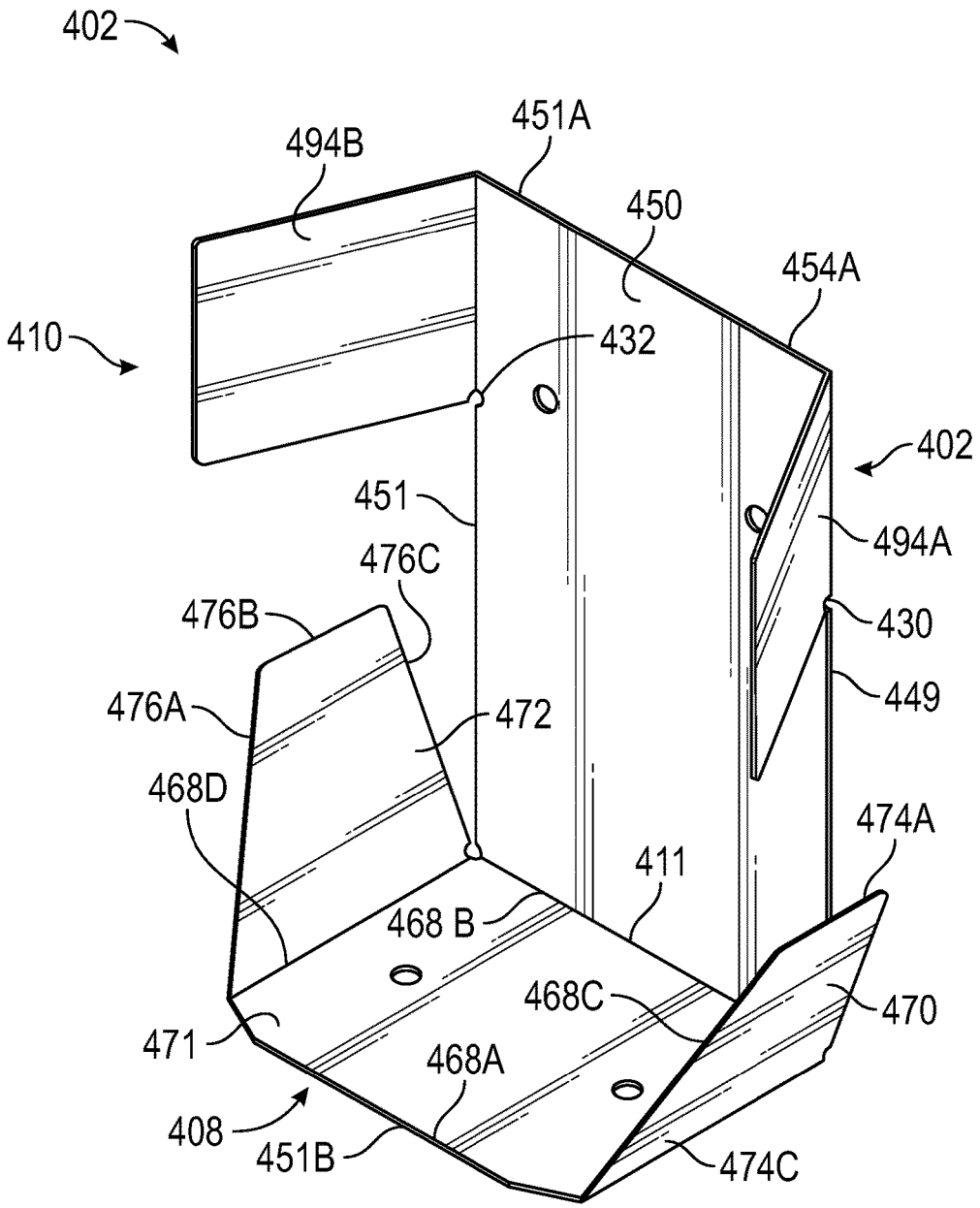
FIGS. 12A-12B illustrate a fourth embodiment of a bracket for use with the framing assembly, according to aspects of the present disclosure.

Referring to FIG. 12A, a fourth embodiment of a bracket 402 for use with the framing assembly 100 is illustrated. The bracket 402 includes a first bracket section 408, and the bracket 402 includes a second bracket section 410 in communication with the first bracket section 408 along a bracket bend 411. In some embodiments, the first bracket section 408 is aligned in perpendicular relation relative to the second bracket section 410 along the bracket bend 411 such that the bracket 402 defines a general L-shaped configuration or 90 degree bracket. In some embodiments, the bracket bend 411 of the bracket 402, or more particularly, the orientation of the first bracket section 408 relative to the second bracket section 410 may vary such that the bracket 402 may define configurations other than a 90 degree bracket. For example, the orientation of the first bracket section 408 relative to the second bracket section 410 along the bracket bend 411 may be such that the bracket 402 may define a configuration in the range of 0-60 degrees, 60-90 degrees, 30-60 degrees, 90 to 120 degrees, and 120 to 150 degrees, and the like. In other embodiments, the second bracket section 410 may be twisted relative to the first bracket section 408 to address different variations of the framing assembly 100 as would be appreciated by one skilled in the relevant art.

As shown, the first bracket section 408 includes a base 471 and first and second lateral wings 470 and 472 that extend outwardly at an angle relative to the base 471. The first bracket section 408 further defines a plurality of sides 468A-468D. The base 471 may be substantially planar or flat and may otherwise extend orthogonally relative to the second bracket section 410 along the bracket bend 411. The first lateral wing 470, defined along the side 468C, is configured to flex or bend in a vertical direction, along the base 471. Similarly, the second lateral wing 472, defined along the side 468D, is configured to flex or bend in a vertical direction, along the base 471. As such, the first and second lateral wings 470 and 472 may be received within a joist interior portion, similar to the manner described in FIGS. 9A-9C.

In some embodiments, the first lateral wing 470 may define a plurality of outer edges 474A-474C. Similarly, the second lateral wing 472 may defined a plurality of outer edges 476A-476C. In some embodiments, each of the plurality of outer edges 474A-474C and the plurality of outer edges 476A-476C may be linear and devoid of curvature. The plurality of outer edges 474A-474C and the plurality of outer edges 476A-476C may scrape against the inside of a joist such as the inside surface of a joist's flanges to hold the bracket in place within a joist interior portion until screws or other permanent securing members can be implemented, as further described herein.

In some embodiments, the second bracket section 410 of the bracket 402 includes a first side 449, a second side 451, and a top side 454. The bracket may further comprise a peripheral open end 451A defined by the second bracket section 410 and a closed peripheral end 451B defined by the first bracket section 408. The second bracket section 410 further defines a base 450, a first lateral portion 494A extending outwardly from the first side 449 along the base 450, and a second lateral portion 494B extending outwardly from the second side 451 along the base 450. As shown, the first and second lateral wings 470 and 472 may be substantially aligned with the first and second lateral portions 494A and 494B.

The second bracket section 410 further defines a first arcuate recess 430 and a second arcuate recess 432 defined proximate the first and second lateral portions 494A and 494B, spaced a predetermined distance from the bracket bend 411. The first and second arcuate recesses 430 and 432 may align with and receive opposing returns of a flange when coupling the bracket 402 to the same.

Figure 12B:
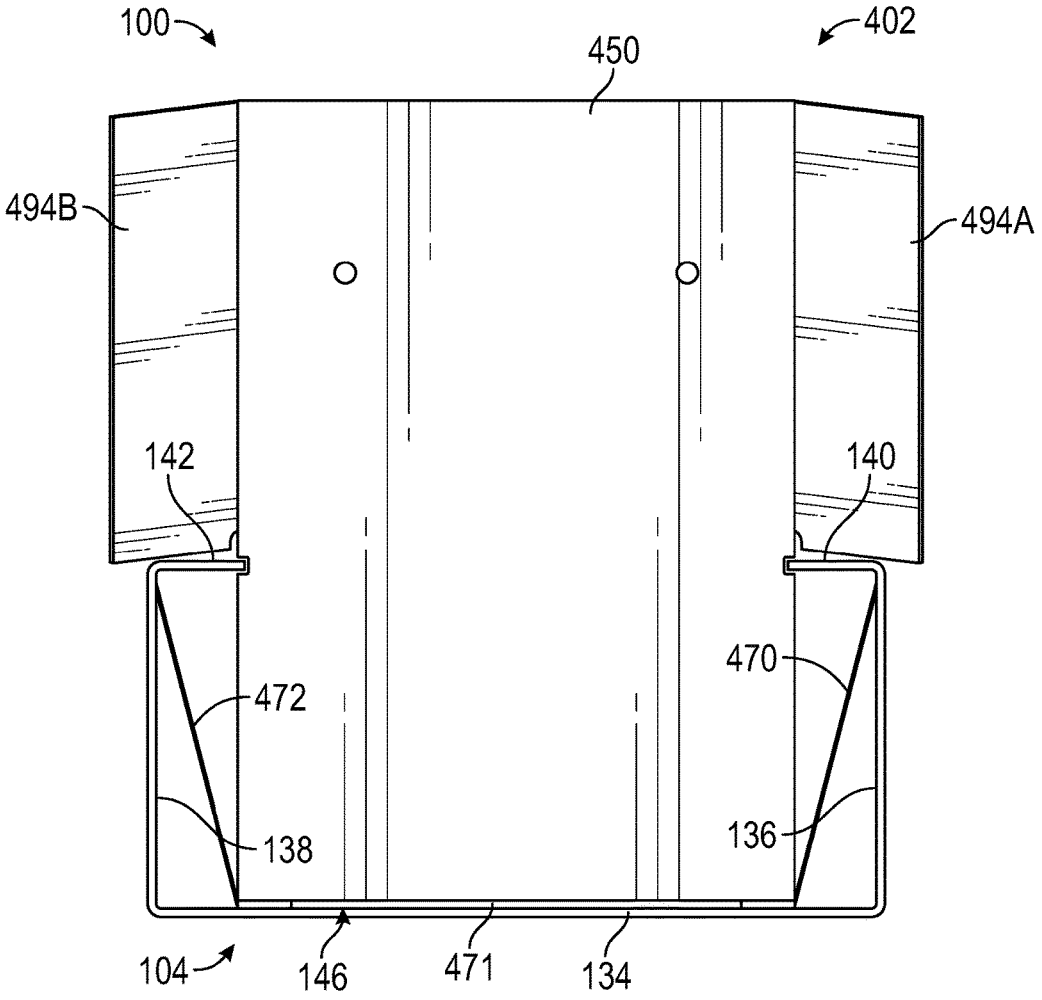

Referring to FIG. 12B, the bracket 402 may be oriented within the joist interior portion 146 similar to the bracket 102 and methods described above. When oriented within the joist interior portion 146, the first lateral portion 494A may be aligned over the return 140, and the second lateral portion 494B may be aligned over the return 142. The base 471 may be aligned along the web 134. The first lateral portion 494A and the second lateral portion 494B may be used to engage with another joist, similar to the wings 170 and 172 and the methods described herein.

In addition, the first lateral wing 470 may extend underneath the return 142, and the second lateral wing 472 may extend underneath the return 140. In some embodiments, the first lateral wing 470 may contact interior surfaces of the flange 136 or the return 140, and the second lateral wing 472 may contact interior surfaces of the flange 138 or the return 142, although other embodiments contemplate no direct contact. In either case, the return 142 overlaps the second lateral wing 472 and the return 140 overlaps the first lateral wing 470 which tends to keep the bracket 102 housed within the joist interior portion 146 of the joist 104.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A system for interlocking framing components comprising:

a joist comprising a web in communication with a first joist flange and a second joist flange that collectively define a joist interior portion; and a bracket configured to be disposed within the joist interior portion and engaged to the first and second joist flanges, respectively, the bracket comprising a first bracket section in communication with a second bracket section such that the first bracket section is aligned in perpendicular relation relative to the second bracket section, a bracket bend defined between the first and second bracket sections, the first bracket section defining a base, a first lateral wing, and a second lateral wing extending outwardly from opposite sides of the base of the first bracket section, with angles defined at intersections between the base and the first lateral wing and the second lateral wing respectively, wherein the first lateral wing and the second lateral wing are configured to bend inwardly relative to the base and reduce the angles to accommodate engagement of the bracket to the joist.

2. The system of claim 1, wherein the bracket further comprises:

a first notch and a second notch defined along opposite sides of the second bracket section.

3. The system of claim 1, wherein the first lateral wing and the second lateral wing are oriented at an obtuse angle relative to the base.

4. The system of claim 1, wherein the first lateral wing and the second lateral wing are configured to be engaged to the first and second joist flanges, respectively, of the joist.

5. The system of claim 4, wherein the first lateral wing and the second lateral wing are configured to flex when engaged to the first and second joist flanges, respectively, of the joist.

6. The system of claim 1, wherein the first joist flange defines a first return formed along a free end of the first joist flange and the second joist flange defines a second return formed along a free end of the second joist flange.

7. The system of claim 6, wherein the first lateral wing is disposed between the web and the first return of the joist and the second lateral wing is disposed between the second return and web of the joist.

8. The system of claim 1, wherein the first bracket section is configured to contact the web of the joist when the bracket is engaged to the joist.

9. The system of claim 1, wherein the first bracket section comprises a plurality of openings configured to receive a respective securing member for engaging the bracket to the joist.

10. The system of claim 1, wherein the second bracket section comprises a plurality of apertures configured to receive a respective securing member.

11. The system of claim 1, wherein the bracket is configured to be initially disposed within the joist interior portion at an angle relative to a longitudinal axis of the joist and then the bracket is rotated relative to the joist until a longitudinal axis of the bracket is aligned in parallel orientation relative to a longitudinal axis of the joist.

12. A method for interlocking framing components comprising:

providing a joist comprising a web in communication with a first joist flange and a second joist flange that collectively define a joist interior portion;

inserting a bracket within the joist interior portion at an angle relative to a longitudinal axis of the joist, the bracket comprising a first bracket section in communication with a second bracket section and a bracket bend defined between the first and second bracket sections, the first bracket section defining a base, a first lateral wing, and a second lateral wing extending outwardly from opposite sides of the base; and positioning the base of the first bracket section along the web of the joist such that the first lateral wing contacts the first joist flange and the second lateral wing contacts the second joist flange, wherein the first lateral wing and the second lateral wing are configured to flex inwardly relative to the base to engage the bracket to the joist.

13. The method of claim 12, further comprising:

disposing the bracket over the web of the joist at an angle relative to the joist;

inserting at least a portion of the first bracket section within the joist interior portion; and applying a downward force to the first bracket section, the downward force causing the first lateral wing and the second lateral wing to flex inwardly relative to the base.

14. The method of claim 12, wherein the first lateral wing flexes in a vertical direction away from the web of the joist.

* * * * *